US006163894A

United States Patent [19]

Simonds

[11] Patent Number: 6,163,894

[45] Date of Patent: Dec. 26, 2000

[54] SANITARY CLIP-ON HANDLE AND METHOD OF USING

[76] Inventor: James C. Simonds, 630 Thomas St., Coopersburg, Pa. 18036

[21] Appl. No.: 09/371,357

[22] Filed: Aug. 10, 1999

Related U.S. Application Data

[63] Continuation-in-part of application No. 09/073,321, May 4, 1998, Pat. No. 5,933,876.

[51] Int. Cl.[7] ..... A47K 13/10

[52] U.S. Cl. ..... 4/246.1

[58] Field of Search ..... 4/246.1; D48/300, D48/301, 305, 321; 16/114 R

[56] References Cited

U.S. PATENT DOCUMENTS

| | | | |
|---|---|---|---|
| D. 324,161 | 2/1992 | Mac Ritchie | D8/307 |
| D. 351,550 | 10/1994 | Clark | D8/307 |
| 3,191,193 | 6/1965 | Bogenberger | 4/246.1 |
| 3,935,601 | 2/1976 | Hermann | 4/251 |
| 4,805,246 | 2/1989 | De Vargas | 4/251 |
| 4,951,324 | 8/1990 | Lirette | 4/251 |
| 5,086,523 | 2/1992 | De Mott | 4/251 |
| 5,375,267 | 12/1994 | Davis | 4/246.1 |
| 5,407,642 | 4/1995 | Lord | 422/122 |
| 5,590,425 | 1/1997 | Janik | 4/246.1 |
| 5,619,758 | 4/1997 | Burkett | 4/246.1 |

*Primary Examiner*—Charles E. Phillips
*Attorney, Agent, or Firm*—Charles A. Wilkinson

[57] ABSTRACT

A sanitary clip-on handle arrangement that may be clipped onto a toilet seat when needed by a user. The clip-on handle includes a handle portion that is fixed to a clip portion. The clip portion provides a clamping arrangement that may be operated by a user to enable the clip-on handle to be temporarily clipped onto a hinge mounted toilet seat for use in lifting and lowering the toilet seat. The handle portion may be rotatable fixed to the clip portion to be movable between a first extended position enabling a person to easily grasp the handle portion, to a second tucked position that is less obtrusive, to a third, even less obtrusive position for storage of the handle portion.

18 Claims, 8 Drawing Sheets

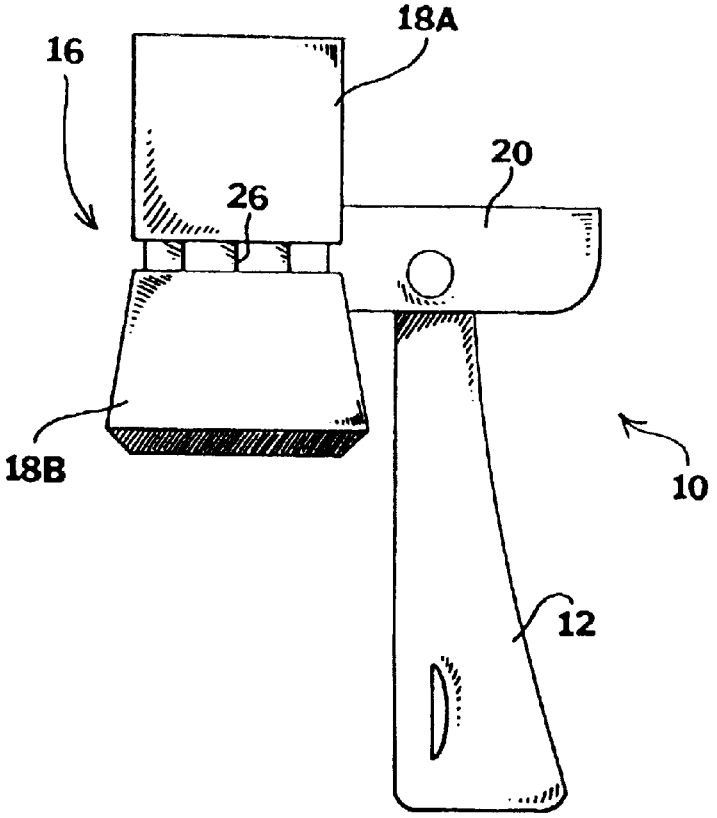
Fig. 3a
Fig. 3b
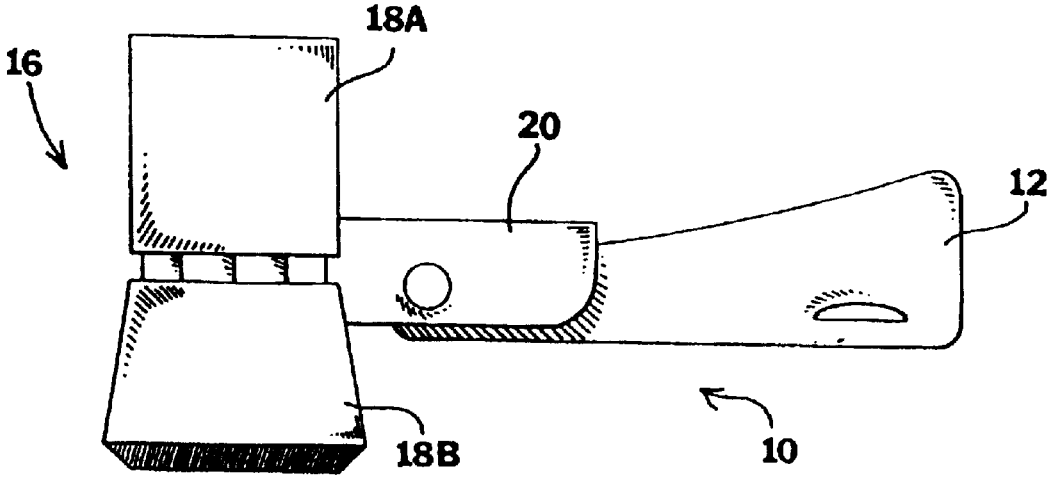

Fig. 4c
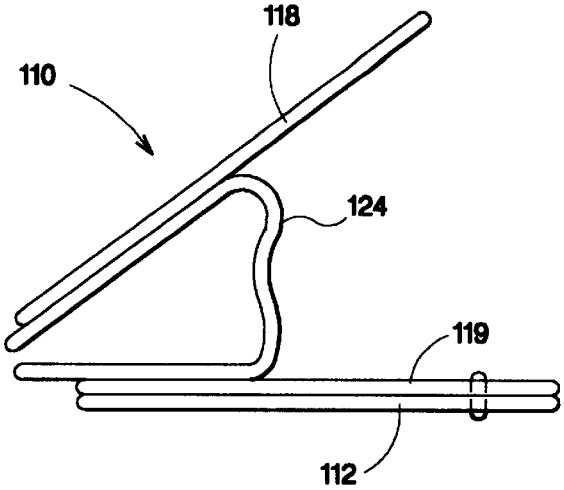
Fig. 6a
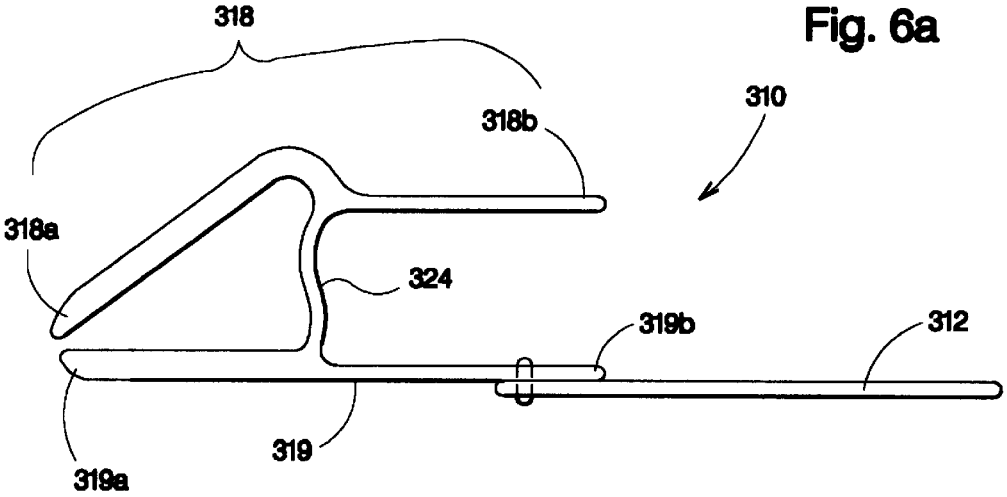
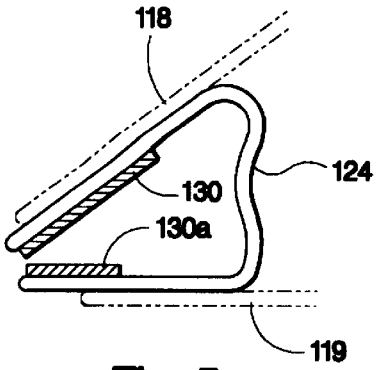
Fig. 5
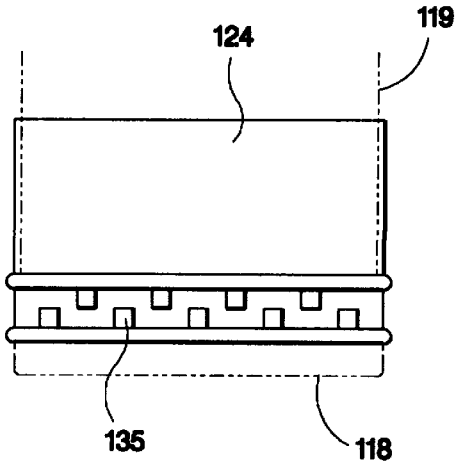
Fig. 5a

SANITARY CLIP-ON HANDLE AND METHOD OF USING

CROSS REFERENCE TO RELATED APPLICATIONS

This application is a continuation-in-part of U.S. application Ser. No. 09/073,321 filed May 4, 1998 now U.S. Pat. No. 5,933,876.

BACKGROUND OF THE INVENTION

1. Field of the Invention

The invention relates generally to sanitary and convenience devices. More particularly, the present invention relates to a sanitary clip-on handle for use in lifting and lowering a toilet seat to minimize the contact by a user of unsanitary surfaces of such toilet seat.

2. Background and Objects of the Invention

The need to use public or common restroom facilities results in a user contacting surfaces, including toilet seats, etc., wherein the contacted surfaces may be contaminated with urine, feces, and or a variety of germ and micro organisms. In cases where such facilities must be used, it is desirable to reduce or minimize the contacting of such surfaces.

A variety of prior art devices have been proposed that are specifically provided and configured for fixed (permanent attachment to a toilet seat. For example, U.S. Pat. No. 3,935,601 to Hermann, provides a device that is fixed to the toilet seat preferably via screws or double sided tape. Other similar devices are provided in U.S. Pat. Nos. D324,161 and D351,550, to MacRitchie and Clark et al., respectively. These devices, along with others known in the art, provide a means to lift a toilet seat without having to touch the actual surfaces of the seat. However, once fixed to the toilet seat, such devices are likely to be contaminated in the same manner that the toilet seat itself is. At minimum, some contamination may be expected. Further such devices can not be easily removed from the toilet seat when the seat requires cleaning, or the lifting device may require cleaning. As these devices are permanently fixed to the toilet seat, they also represent a possible hazard since each extends outwardly from the seat and can be easily bumped or walked into.

Another device known in the art that is partially removable is provided by U.S. Pat. No. 5,086,523 to De Mott et al. This device includes two major portions. The first portion is fixed to the under side of the toilet seat, while the second portion, which is tab-like in shape is provided with a hole in one end. The second portion is arranged to slide into the first portion and further includes a deodorizing means. This device suffers from many of the drawbacks discussed above.

Objects of the present invention are, therefore, to provide new and improved sanitary toilet seat lifting and lowering devices having one or more of the following capabilities, features, characteristics, and/or advantages:

- configured with a clamping portion to clip or clamp onto a toilet seat when in use, and be easily removed therefrom when not being used;
- configured to be easily carried in a pocket, handbag, and the like, and attached to a toilet seat when required;
- includes a rounded, elongated, and preferably foldable handle portion;
- the handle portion may be configured to be movable between a first extended position enabling a person to easily grasp the handle portion, to a second tucked position wherein the handle portion is less obtrusive, and to a third position for storage of the handle portion;

having a simple low cost construction.

The above listed objects, advantages, and associated novel features of the present invention, as well as others, will become more clear with a careful review of the description and figures provided herein. Attention is called to the fact, however, that the drawings and the associated description are illustrative only, and variations are certainly possible.

SUMMARY OF THE INVENTION

In accordance with the present invention a clip-on handle arrangement is provided that may be clipped onto a hinge mounted toilet seat to assist a user in raising and lowering the toilet seat, and subsequently quickly and easily removed therefrom. The clip-on handle comprises a handle portion with a clip portion suitably fixed to, or coupled to, the handle portion. The clip portion is arranged to have a clamping arrangement that may be operated by a user and moved into an open position, and when released by the user is biased to a closed position for suitably clipping onto the toilet seat. Accordingly, the clip-on handle is configured to be temporarily clipped onto the toilet seat for use in lifting and lowering the seat, and may be quickly removed therefrom by the user appropriately grasping and operating the clip portion into the open position, thereby releasing the clip-on handle arrangement from the toilet seat.

In a preferred embodiment of the invention the handle portion is movably or rotatably fixed to the clip portion to enable the handle portion to be moved into in a first extended position enabling a person to easily grasp the handle portion, a second tucked, less obtrusive position wherein the handle portion extends substantially parallel to, and along an outer edge of the toilet seat, and a third, storage position wherein the handle portion is generally aligned with and substantially parallel to the clip portion, which position is much less obtrusive than the second, tucked position.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of many possible arrangements utilizing the fundamental concepts of the present invention. The drawings are briefly described as follows:

FIGS. 3A and 3B illustrate the clip-on handle in a first extended position and a second tucked position, respectively.

FIG. 4 is a perspective view and FIGS. 4A–4C are side views of an alternative embodiment of the clip-on handle of the invention with the handle portion coupled directly to one of the clamping members.

FIG. 5 is a side view and FIG. 5A is a front view of the bias arrangement or member of FIGS. 4 through 4C shown with gripping enhancements along the inside surfaces of such bias arrangement or member.

FIGS. 6 and 6A are side views of another alternative embodiment of the clip-on handle of the invention shown with the clamping members and the bias member being of a unitary construction.

DETAILED DESCRIPTION OF THE PREFERRED EMBODIMENTS

It is important to establish the definition of several terms expressions that will be used throughout this disclosure. The expressions "clip-on handle," "clip-on handle arrangement," "handle clip," and "sanitary clip-on handle," are equivalents that will be used interchangeably in the following disclosure. The expressions "clip means" and "clip portion" are also to be defined as equivalents and are intended to indicate any arrangement that may be employed to enable a user to quickly, easily, and somewhat firmly attach the clip-on handle of the present invention to a (hinge mounted) toilet seat. As skilled individuals will appreciate, the toilet seat may be configured as a single hinged ring that may be lifted and lowered, or alternately, the toilet seat may comprise a ring portion with a lid portion that may be positioned (in a lowered position) so as to substantially cover the ring portion. Accordingly, with either the former or the latter toilet seat configurations, the clip-on handle of the present invention is contemplated to be clipped onto either portion of the toilet seat. Additional terms and expressions will be defined below as needed.

Figure 1:
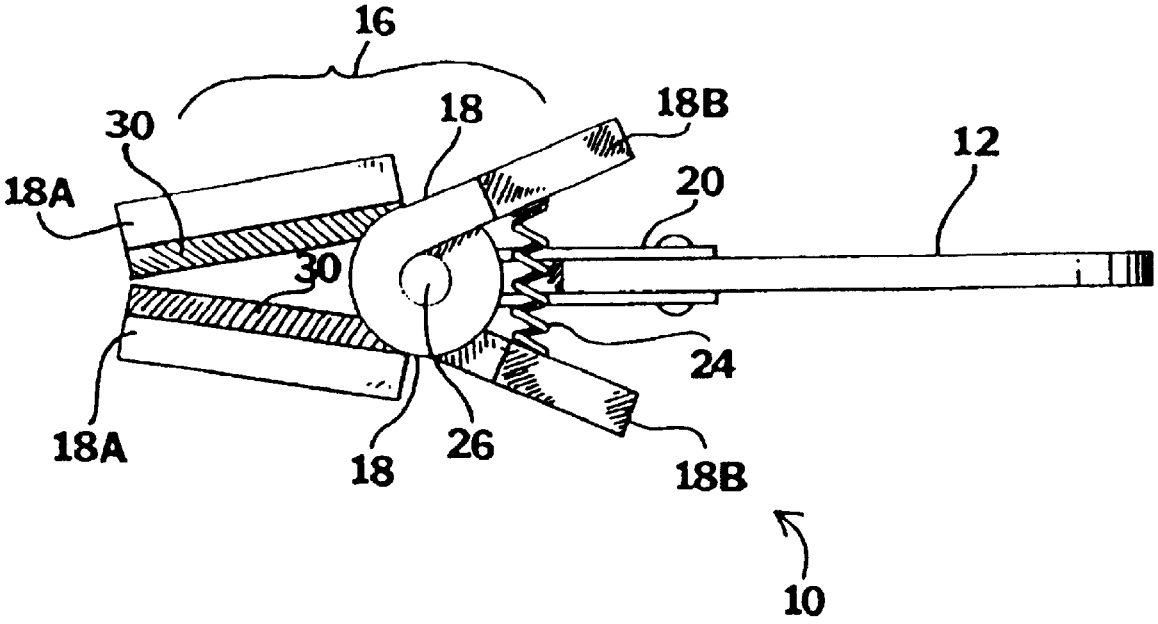
FIG. 1 provides a profile or side view of an embodiment of the sanitary clip-on handle of the present invention.
Figure 2:
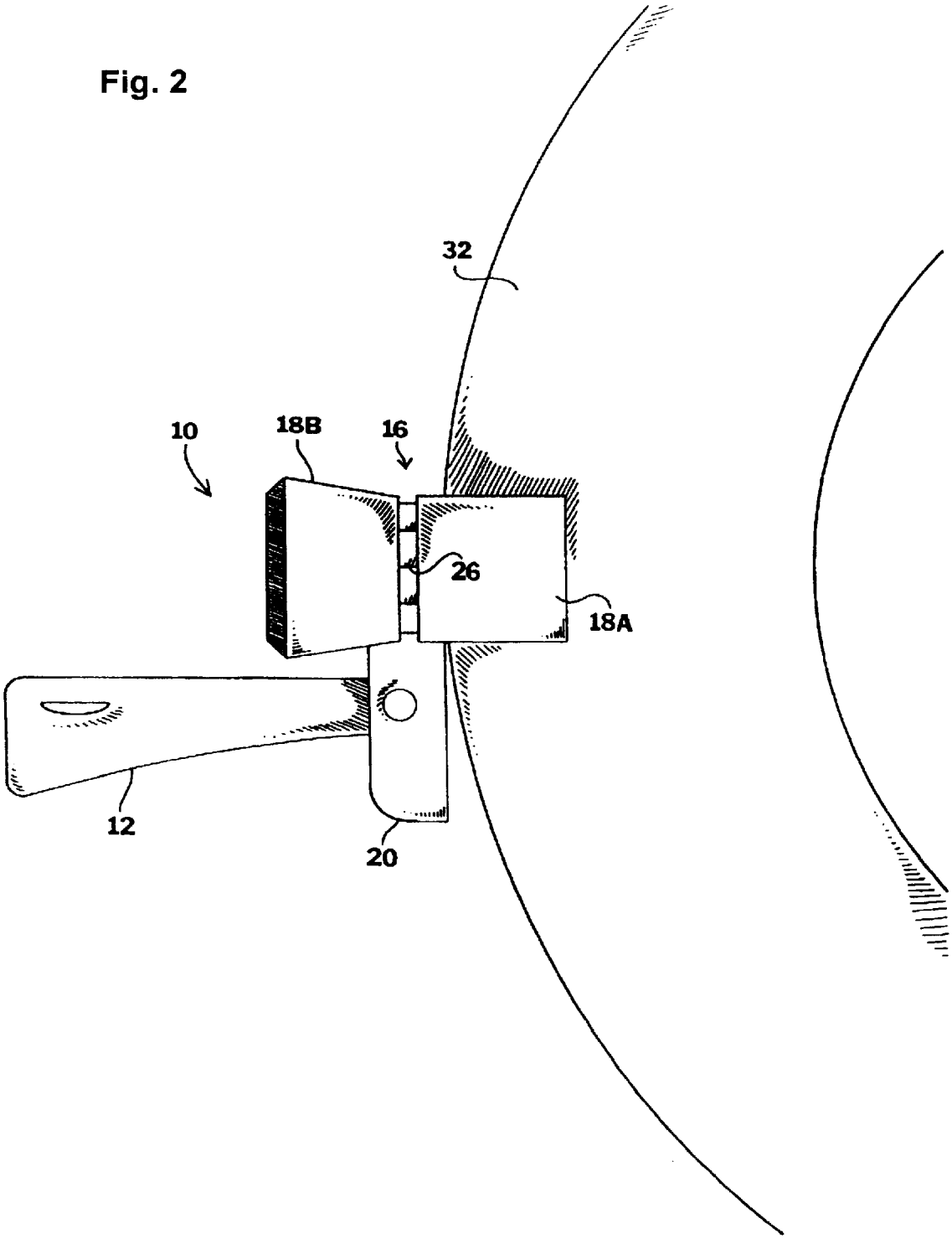
FIG. 2 depicts a plan view of the clip-on handle clamped onto (a ring of) a toilet seat and available for use.

Referring now to FIG. 1, there is depicted a side view of an embodiment of the sanitary clip-on handle 10 of the present invention. As can be seen therein, a handle portion 12, which may preferably be elongated, is suitably coupled to a clip means, such as clip portion 16. The clip portion 16 is configured to enable the clip-on handle 10 to be temporarily clipped (or clamped) onto the toilet seat 32 (as seen in FIG. 2) for use in lifting and lowering the toilet seat 32. Therefore, the inclusion of a properly configured clip portion 16 clearly enables the clip-on handle 10 to be quickly attached to, or removed from, the toilet seat 32 by the user.

As can be seen in FIGS. 1 and 2, the embodiment of the clip portion 16 illustrated therein may be comprised of a plurality of opposing clamp members 18 (two members as depicted) that are rotatably fixed proximal to the center of each clamp member 18. For example, a hinge means 26 may be included to rotatably couple or fix the clamp members 18, as can be seen in either of FIG. 1 or FIG. 2. Accordingly, the clamp members 18, each of which has a clamping end 18*a* and a tab end 18*b*, may be operated by a user (via the tab end 18*b*) and moved into an open position wherein the clamping ends are spaced to enable the clip portion 16 to be suitably positioned with the toilet seat 32 between the clamping ends 18*a*. When subsequently released by the user, the clip portion 16 assumes a closed position suitably clamping or clipping the clip-handle 10 onto the toilet seat 32, as shown in FIG. 2. It may be noted that the term "suitably positioned" is intended to indicate the positioning of the clip portion 16 in a manner as shown in FIG. 2, wherein the clamping ends 18*a* of the clip portion 16 may somewhat firmly clamp onto the toilet seat 32 (when released). Thus, by a user appropriately grasping and operating the tab ends 18*b* of the clamp members 18, the clip portion 16 may be placed or moved into an open position, suitably positioned with the toilet seat 32 between the clamping ends 18*a*, and then released by the user so that the clamping ends 18*a* clamp the clip-on handle 10 onto the toilet seat 32.

As can be seen in FIGS. 3A and 3B, the handle portion 12 of the present invention may preferably be suitably coupled to the clip portion 16 so as to enable the handle portion 12 to be movable between either a first extended position enabling a person to easily grasp the handle portion 12 (to lift and lower the toilet seat 32) and a second tucked, less obtrusive position. When in the second position, the handle portion 12 extends substantially parallel to, and possibly abutting, an outer edge of the toilet seat 32. This feature is important because it enables the handle portion 12 to be folded and moved out of the way, if desired by a user. It is important to note a support member 20 represents an exemplary manner in which the handle portion 12 and the clip portion 16 may be "coupled". Further, skilled persons will recognize that the support member 20, as best seen in FIGS. 2, 3A and 3B, is configured to enable the handle portion 12 to be tucked (as shown in FIG. 3B) in a single direction. This need not be the case as the support member 20 may be modified to enable the handle portion 12 to swivel in either direction if necessary or desired. However, in a preferred embodiment of the present invention the handle portion 12 and the clip portion 16 are permanently coupled (e.g., rotatably fixed) to each other.

Referring again to the embodiment of FIG. 1, the opposing clamp members 18 are shown rotatably fixed proximal to the center of each clamp member 18 with the clip portion 16 having a spring 24, which may be termed a biasing means, provided to bias the clamp members to the closed position when not being operated by a user. The spring 24 represents one arrangement that may be provided to bias the clamp members to the closed position. Also best seen in FIG. 1, on an inner surface of each clamping end 18*a* of each clamp member 18 are rubberized patches 30 that are secured to the inner surfaces to enable the clip portion 16 to more securely and firmly hold the clip-on handle 10 on the toilet seat 32.

An important feature of the preferred embodiments of the invention is the ability of a user to temporarily (and rapidly) clip the clip-on handle 10 onto a hinge mounted toilet seat 32 for use in lifting and lowering the toilet seat, and subsequently enabling the user to quickly remove the present invention from the toilet seat. As such, it is contemplated that the user may carry the clip-on handle 10, say in a pocket or a handbag, until needed for use. The handle may then be clipped onto a toilet seat and used as needed, and subsequently unclipped and washed (if necessary) before being stored away. Accordingly, a most preferred embodiment of the present invention would be configured to be compact, lightweight, and very portable.

Figure 4:
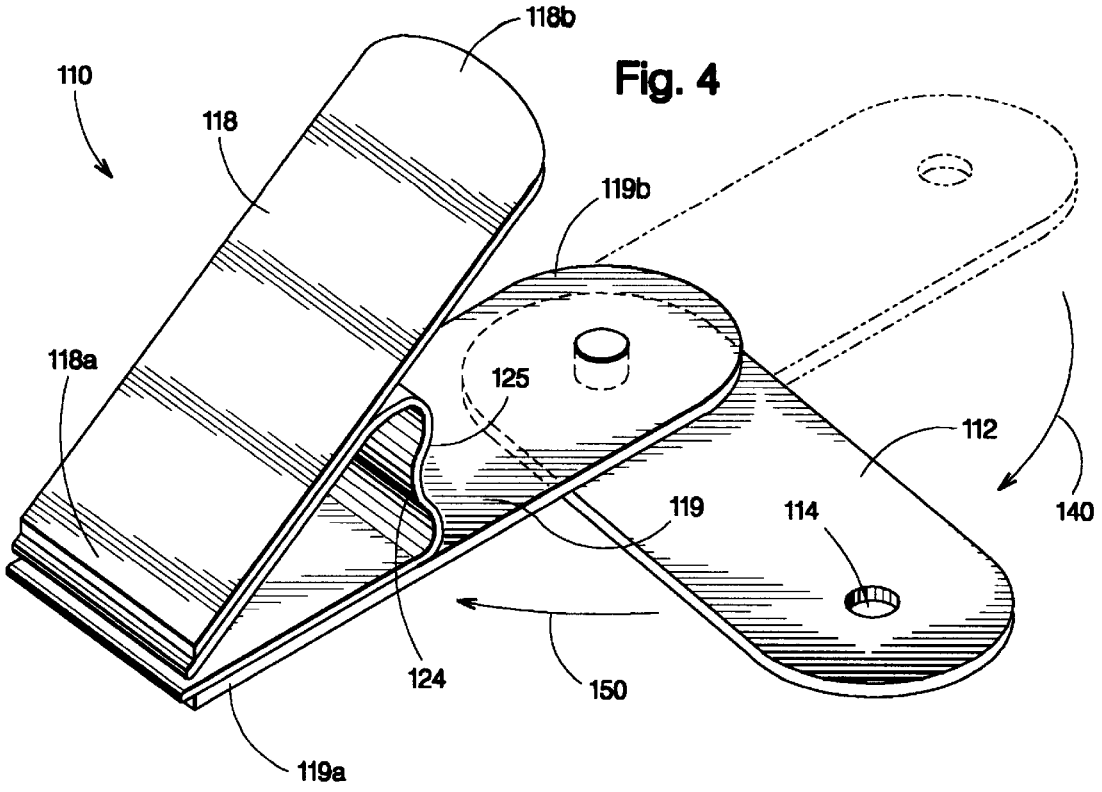
Figure 4A:
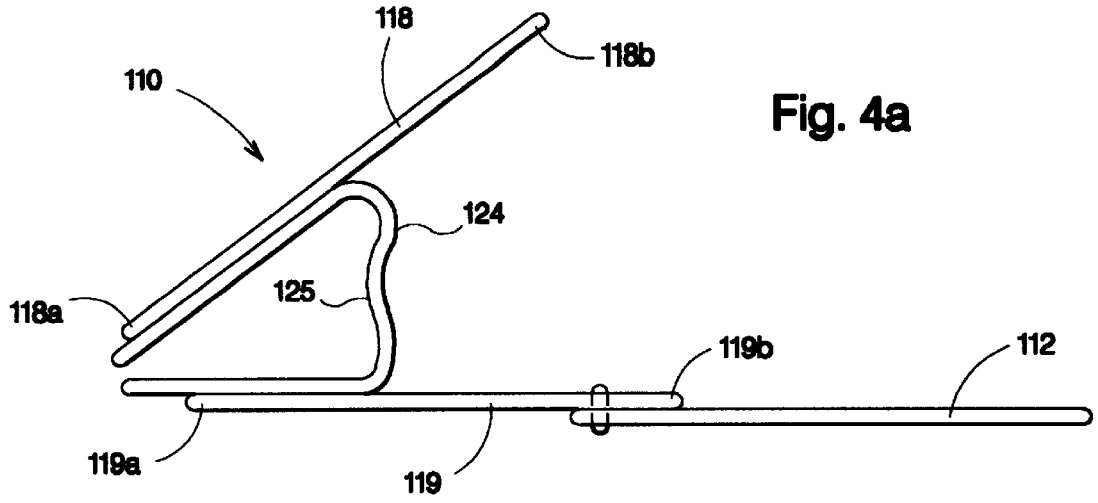
Figure 4B:
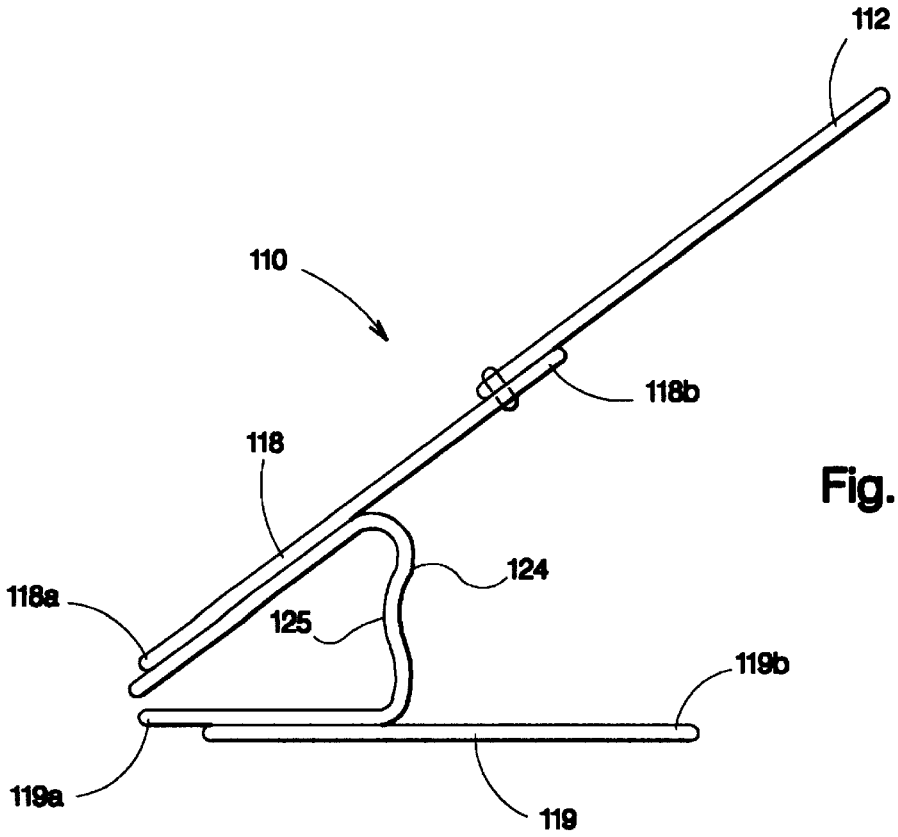

FIG. 4 is a perspective view and FIGS. 4A–4C are side views of an alternative embodiment of the clip-on handle 110 of the invention. A clamping arrangement, defined by clamp members 118 and 119, each having a clamping end 118*a* and 119*a* respectively for clamping onto a toilet seat and a tab end 118*b* and 119*b* respectively for operation by a user, are coupled via a flexible bias arrangement 124. The bias member or arrangement 124 maintains the clamping ends 118*a* and 119*a* of the clamping members 118 and 119 in a closed relationship in the absence of a gripping force placed on the tab ends 118*b* and 119*b*, yet allows such clamping ends to separate when a force is imparted to the tab ends in preparation for attachment of the clip-on handle 110 to a toilet seat 32 (not shown, but shown in previous figures) by way of a weakened portion 125 in the middle to allow for flexure of such bias member material and rotation of the clamping members 118 and 119 about the bias arrangement 124. The handle portion 112 is rotatably coupled directly to the tab end 119*b* of the clamp member 119 in FIG. 4A, or directly to the tab end 118*b* of the clamp member 118 in FIG. 4B, which eliminates the need for the support member 20 illustrated in FIGS. 1 through 3B. A gripping force on the tab ends 118*b* and 119*b* urging such tabs ends together causes, via the bias arrangement 124, the clamping ends 118*a* and 119*a* to separate a suitable distance for attachment to a toilet seat 32 (shown in earlier figures), while the subsequent gripping of the handle portion 112 allows a user to move a toilet seat without actually touching the toilet seat and exposing the user to potential contamination from germs and other undesirable substances. The handle portion 112 preferably includes a string- or chain-receiving orifice 114 for attachment of the clip-on handle 110 to a section of the toilet, wall or the like, as will described in more detail below.

As seen in FIG. 4, the handle portion 112 is rotatable between a first, extended position enabling a person to easily grasp the handle portion, to a second, tucked position, wherein the handle portion is less obtrusive and lies generally parallel to the edge of a toilet seat once the clip-on handle 110 is clamped thereon, to a third storage position, see FIG. 4C, wherein the handle portion lies parallel to or adjacent the clamping member to which the handle portion is attached. The first, extended position of the handle portion provides the user with the most leverage and the greatest ability to manipulate the clip-on handle 110, while the third, storage position increases the compactness and portability of the clip-on handle 110 as compared with the previously embodiment of FIGS. 1–3B.

The clamping ends 118*a* and 119*a* of the clip-on handle 110 could be equipped with enhanced gripping means for securing the clip-on handle to a toilet seat. As shown in FIG. 5, which is a side view of just the bias arrangement 124 with the clamping members 118 and 119 shown in phantom for purposes of illustration, rubberized patches 130 extending along the inside surface or 130*a* just near the clamping ends could be secured to the inner surfaces of the bias means to enable the clamping members 118 and 119 to more securely and firmly hold the clip-on handle 110 on the toilet seat, while in FIG. 5A, which is a front view of the clamping ends of the bias arrangement, protrusions, namely ridges or channels or the like 135 extending along the inner surfaces of the bias arrangement could also enable the clamping members 118 and 119 to more securely and firmly hold the clip-on handle 110 on a toilet seat. Other equivalent frictional means could also be provided to enhance the toilet seat grip of the clip-on handle.

Figure 6:
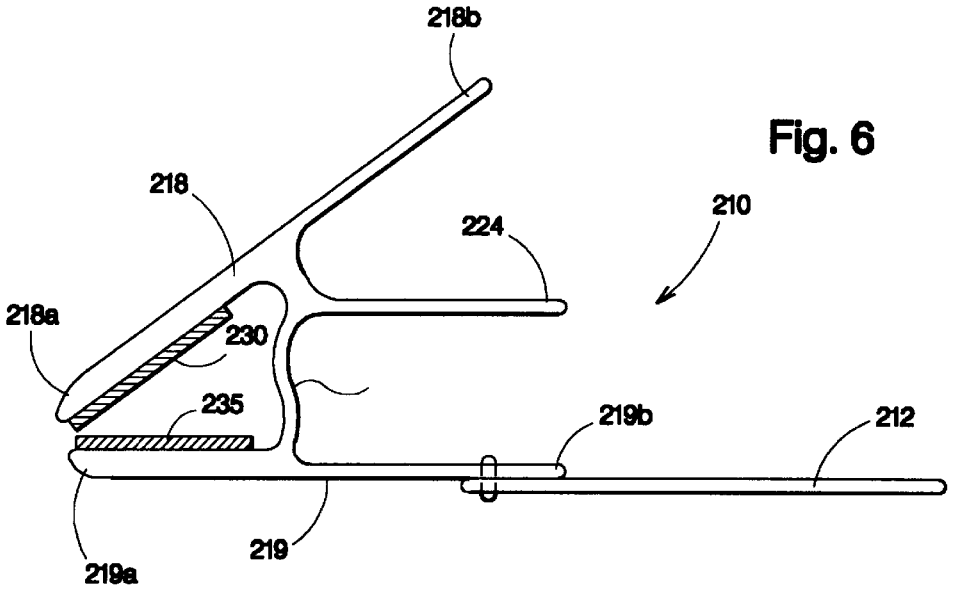

FIG. 6 is a side view of an alternative embodiment of the clip-on handle 210 of the invention, wherein the clamping members 218 and 219, comprised of clamping ends 218*a*, 219*a* and tab ends 218*b*, 219*b*, are coupled by a bias arrangement 224 that functions in an analogous manner as the bias arrangements 24 and 124 described previously, with the clamping members 218, 219 and bias arrangement 224 formed from a unitary construction for ease of manufacturing, cleaning and the like. The handle portion 212 functions in an analogous manner as the handle portion 112 of FIGS. 4–5A, rotatably coupled to one of the clamping members and swingable between an extended position, a less obtrusive tucked position and finally a storage position. The gripping ends 218*a* and 219*b* of the clamping members 218 and 219 could be provided with gripping enhancements, such as rubberized patches 230, ridges or channels 235 or the like, on one or both of the inner surfaces of the clamping members, which could improve the attachment of the clip-on handle 210 to a toilet seat once clamped thereon (not shown). FIG. 6A is a side view of yet another alternative embodiment of the clip-on handle 310 of the invention, wherein the clamping members 318 and 319, comprised of clamping ends 318*a*, 319*a* and tab ends 318*b*, 319*b*, are coupled by a bias arrangement 324, with the clamping members 318, 319 and bias arrangement 324 formed from a unitary construction for ease of manufacturing, cleaning and the like, and with the clamping end 318*b* of the clamping member 318 angled more toward the clamping end 319*a* of the clamping member 319 for more compact packaging and easier use. Application of a force upon the tab ends 318*b* and 319*b* for biasing of the clamping ends 318*a* and 319*b* is easier when the distance between the tab ends is reduced, and it also tends to be easier on the fingers to compress two substantially parallel members, such as tab ends 318*b* and 319*b* shown in FIG. 6A. Of course, the handle portion 312, which is rotatable coupled to the clamping member 319, could also be coupled to the clamping member 318 as described above, and additional gripping enhancements such as rubberized patches, ridges, channels or the like, could also be incorporated in or on the clamping ends 318*a* and/or 319*b* as also described above.

Figure 7:
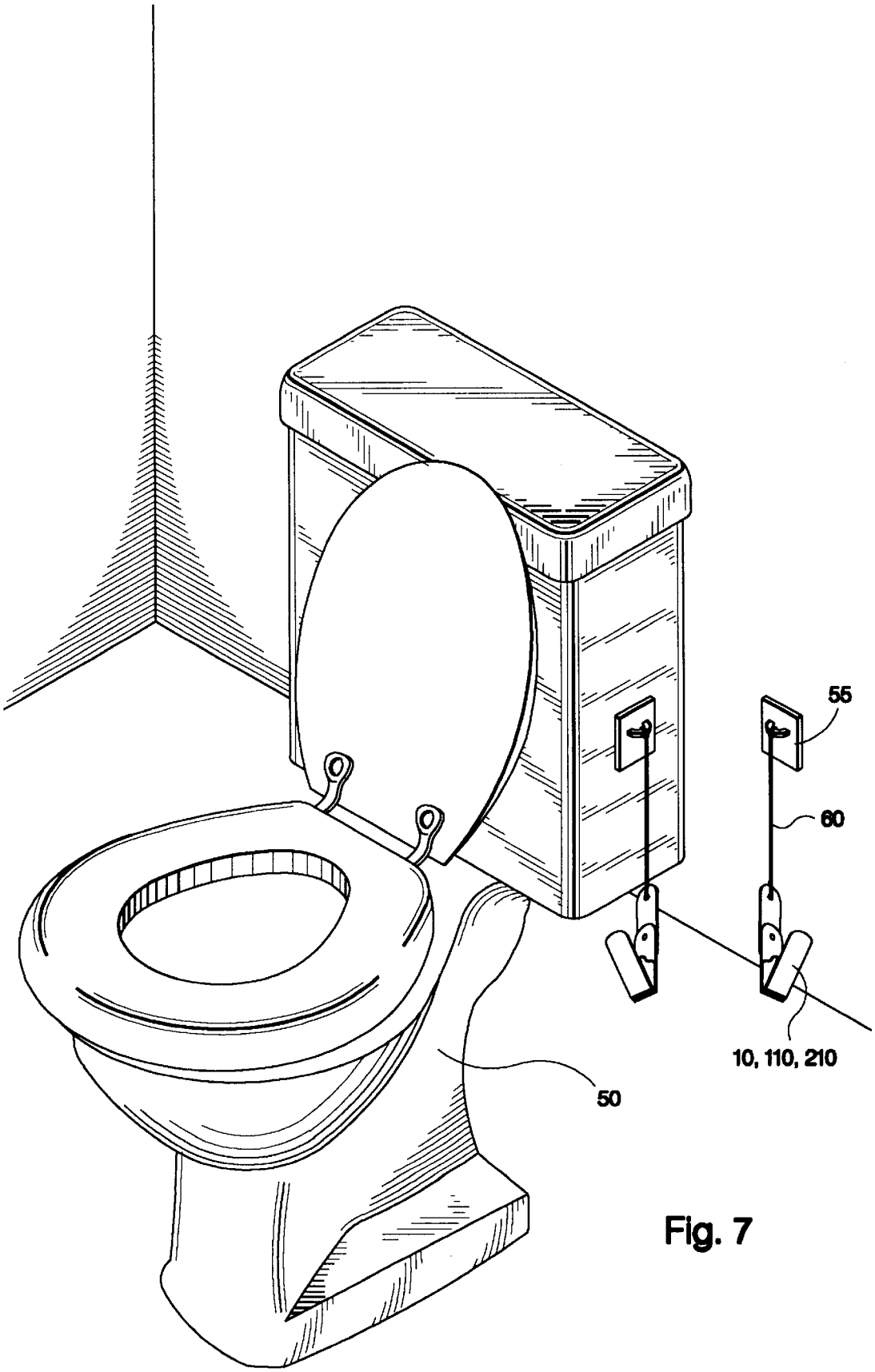
FIG. 7 is a diagrammatic view of a pair of sanitary clip-on handles prepositioned in a location near the toilet seat, one clip-on handle suspended from a toilet tank and one clip-on handle suspended from a nearby wall.
Figure 8:
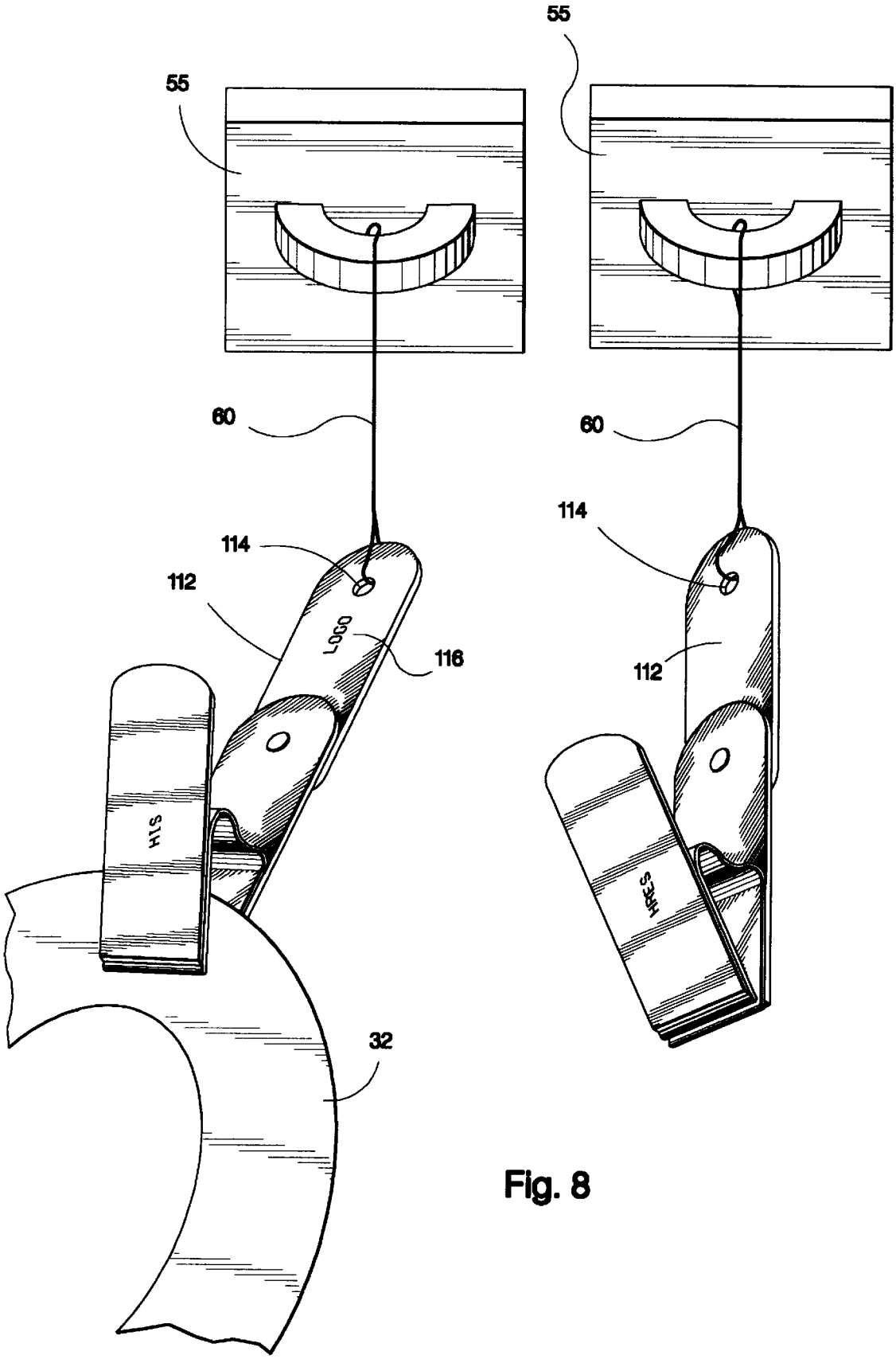
FIG. 8 is a diagrammatic view of a pair of sanitary clip-on handles of the invention, one clip-on handle shown suspended from a location adjacent the toilet seat and one clip-on handle attached to a toilet seat.

The clip-on handle of the present invention is designed to be lightweight, portable and compact, such that a user of a public restroom or the like would be able to easily carry a clip-on handle of the invention during such user's travels without worrying about being contaminated by germs that are known to infect public restroom and the like. FIGS. 7 and 8 illustrate use of the clip-on handle of the invention where such clip-on handle might be removably attached, via orifice 114 in handle portion 112 (see FIG. 4), to a nearby surface, such as on the tank of a toilet 50 or hanging from a wall 55 or the like. FIG. 7 illustrates the suspension of a clip-on handle 10, 110, 210 via chain or string means 60 from nearby surfaces in preparation for use, while FIG. 8 illustrates use of the clip-on handle in the home, showing, for purposes of illustration, a pair of "HIS" and "HERS" clip-on handles for use by, for example, a husband and wife. Of course, FIG. 8 could also illustrate a public bathroom having one or more clip-on handles for use by public users. The clip-on handles shown in FIGS. 7 and 8 are preferably removably attached to the wall for purposes of cleaning and storage, and in case it is desired to travel with one or more clip-on handles of the invention. The suspension means 60 will be of a sufficient length to allow a user to completely lift and lower a toilet seat with the clip-on handle while the clip-on handle remains attached to a wall, toilet tank or the like.

As illustrated generally in FIGS. 7 and 8, and as described above, a user would hold or grasp the sanitary handle clip of the invention by the tab ends and place the clamping ends of the clamping members adjacent a toilet seat in preparation for attachment to a toilet seat. Of course, if desired, the sanitary handle clip may be prepositioned near toilet seat, i.e. suspended from a string, chain or the like on a nearby wall or against the tank of the toilet, see FIG. 7, for easy access and use, particularly in public restrooms or even in one's home. Holding the handle clip by the tab ends, the user would then exert a compressive force upon the tab ends to urge the tab ends toward each other and the clamping ends away from each other, thereby allowing attachment of the clamping ends to the toilet. Once the clamping ends are attached to the toilet, the user releases the force upon the tab ends and the clamping ends remain removably attached to the toilet seat. If necessary, the clamping ends may be enhanced with gripping or frictional enhancements, such as rubberized patches or the like, to assist in such attachment. The user would then handle the sanitary handle clip when it is desired to lift and lower the toilet seat, and after the user has finished answering the "call of nature," the user would remove the sanitary handle clip from the toilet seat by exerting a force upon the tab ends to urge the tab ends toward each other and the clamping ends away from each other, providing the user with the ability to remove the sanitary handle clip from the toilet seat. The user may then return the sanitary handle clip to its suspended position adjacent the toilet seat, or such user may remove the sanitary handle clip from the chain or the like and wash the sanitary handle clip in preparation for future use.

The handle portion 112 of the clip-on handle might also be equipped with means for adapting the placement of the sanitary clip-on handle arrangement into the restroom of a particular establishment. Such means might include a fancy color, logo or the like, 116, or some other marketing tool which might make the coordinated placement of the clip-on handle in certain establishments highly desirable. For example, fast food establishments wishing to present their customers with a clean, rest room environment, might provide clip-on handles having the restaurant's trademarked colors or logo printed thereon, or the handle portion might be of a particular shape, such as a big "M" when used in a McDonalds® restaurant. One skilled in the art will recognize other means of adapting the appearance of the clip-on handle arrangement to a particular environment. Similarly, hotels providing their customers with the option of using a clip-on handle of the invention might print the name of the hotel on the handle portion, or on some other surface of the clip-on handles, such as the clamping members or clip portion or the like. Consequently, while the sanitary clip-on handle of the invention is highly desirable from a functional viewpoint, many vendors will be able to easily integrate the placement of a clip-on handle in their restroom facilities with the use of colors or logos printed thereon.

It is important to understand that the description of the embodiments of the clip-on handle 10 of the present invention are illustrative only, and other equivalent arrangements are certainly possible. For example, the clip portion, bias arrangement, handle portion and the like, of the present invention may be provided in many varying forms. Therefore, while there have been described the currently preferred embodiments of the present invention, those skilled in the art will recognize that other and further modifications may be made without departing from the present invention, and it is intended to claim all modifications and variations as fall within the scope of the appended claims.

I claim:

1. A sanitary clip-on handle arrangement adapted to be clipped onto a hinge mounted toilet seat and later removed, comprising:

a. a handle portion movably coupled to a clamping arrangement, the clamping arrangement adapted for operation by a user and movable into an open position, and when released by the user is biased into a closed position for clipping onto a toilet seat, b. the handle portion being capable of movement from a first extended position enabling a person to easily grasp the handle portion, to a second tucked, less obtrusive position wherein the handle portion extends substantially parallel to the toilet seat, to a third storage position wherein the handle portion extends substantially parallel to the clamping arrangement, c. the clamping arrangement further comprising a plurality of opposing clamp members and a flexible bias arrangement provided to bias the clamp members to the closed position, each clamp member having a tab end for engagement by a user into the open position and a clamping end for clipping onto the toilet seat, d. the clip-on handle arrangement configured to be temporarily clipped onto the toilet seat for use in lifting and lowering the toilet seat, and capable of quick removal therefrom by the user by grasping and operating the tab ends of the clamping arrangement into the open position, thereby releasing the clip-on handle arrangement from the toilet seat.

2. The sanitary clip-on handle arrangement according to claim 1 wherein the handle portion is rotatably coupled to only one of the clamp members.

3. The sanitary clip-on handle arrangement according to claim 1 wherein the handle portion further comprises an orifice for receiving a suspension means for suspension of the sanitary clip-on handle arrangement from a separate surface or object.

4. The sanitary clip-on handle arrangement according to claim 1 wherein an inner surface of each clamping end of each clamp member has secured thereto a rubberized patch provided to more securely hold the sanitary clip-on handle arrangement to the toilet seat.

5. The sanitary clip-on handle arrangement according to claim 1 wherein an inner surface of each clamping end of each clamp member has provided thereon protrusions to more securely hold the sanitary clip-on handle arrangement to the toilet seat.

6. The sanitary clip-on handle arrangement according to claim 1 wherein the handle portion comprises a means for coordinating the placement of a clip-on handle arrangement in a particular dining or entertainment establishment.

7. The sanitary clip-on handle arrangement according to claim 6 wherein the coordinating means consists of the establishment's logo printed on the sanitary clip-on handle arrangement.

8. The sanitary clip-on handle arrangement according to claim 6 wherein the coordinating means consists of the establishment's colors printed on the sanitary clip-on handle arrangement.

9. The sanitary clip-on handle arrangement according to claim 3 further comprising suspension means removably attached through the orifice for removable attachment of the sanitary clip-on handle arrangement to a separate surface or object.

10. A sanitary handle clip for attachment to a toilet seat for the lifting and lowering of such toilet seat, the sanitary handle clip adapted for quick attachment and removal from the toilet seat, comprising;

a. a pair of clamping members flexibly coupled by a flexible bias member, b. each clamping member having a tab end for engagement by a user and a clamping end for removable attachment to the toilet seat, c. the clamping ends being movable from a first, open position when the tab ends are forcefully urged toward each other, to a second, closed position when the force is released from the tab ends for attachment of the clamping ends to the toilet seat, and d. a handle portion rotatably coupled to one of the clamping members, the handle portion movable between at least two positions, one handle portion position being adapted for grasping by a user for manipulation of the toilet seat; wherein, the handle portion is movable between a first position extending away from the clamping member to which the handle portion is coupled and in alignment therewith, to a second position substantially perpendicular to such coupled clamping member, and to a third position wherein the handle portion is positioned substantially adjacent such coupled clamping member, for storage of the handle portion during periods of nonuse.

11. The sanitary handle clip according to claim 10 wherein the friction means is positioned along the inner surfaces of the flexible bias member.

12. The sanitary handle clip according to claim 10 further comprising frictional means along the clamping ends to enhance the attachment of the sanitary handle clip to the toilet seat.

13. The sanitary handle clip according to claim 12 wherein the frictional means comprises a rubberized patch along an inner surface of at least one clamping member.

14. A method of using a sanitary handle clip for attachment to a toilet seat for the lifting and lowering of such toilet seat, the sanitary handle clip adapted for quick attachment and removal from the toilet seat, comprising:

a. a pair of clamping members flexibly coupled by a flexible bias member, b. each clamping member having a tab end for engagement by a user and a clamping end for removable attachment to the toilet seat, c. the clamping ends being movable from a first, open position when the tab ends are forcefully urged toward each other, to a second, closed position when the force is released from the tab ends for attachment of the clamping ends to the toilet seat, and d. a handle portion rotatably coupled to one of the clamping members, the handle portion movable between at least two positions, one handle portion position being adapted for grasping by a user for manipulation of the toilet seat; wherein, the handle portion is movable between a first position extending away from the clamping member to which the handle portion is coupled and in alignment therewith, to a second position substantially perpendicular to such coupled clamping member, and at a third position wherein the handle portion is positioned substantially adjacent such coupled clamping member, for storage of the handle portion during periods of nonuse; comprising:

holding the sanitary handle clip by the tab ends, placing the clamping ends of the clamping members adjacent the toilet seat, exerting a force upon the tab ends to urge the tabs ends toward each other and the clamping ends way from each other, positioning the toilet seat between the clamping ends, releasing the force upon the tab ends to attach the clamping ends to the toilet seat, handling the sanitary handle clip for lifting and lowering the toilet seat, and removing the sanitary handle clip from the toilet seat once finished with the toilet by exerting a force upon the tab ends to urge the tab ends toward each other and the clamping ends away from each other.

15. A method of using a sanitary handle clip in accordance with claim 14 wherein the sanitary handle clip further comprises prepositioning the sanitary handle clip in a location near the toilet seat prior to the initial holding of the sanitary handle clip by the tab ends.

16. A method of using a sanitary handle clip in accordance with claim 15 wherein the prepositioning of the sanitary handle clip further comprises suspending the sanitary handle clip from a wall section near the toilet seat.

17. A method of using a sanitary handle clip in accordance with claim 15 wherein the prepositioning of the sanitary handle clip further comprises suspending the sanitary handle clip from the toilet tank.

18. A method of using a sanitary handle clip in accordance with claim 16 wherein the sanitary handle clip further comprises a handle portion rotatably coupled to one of the clamping members and having an orifice located therethrough, and the suspending of the sanitary handle clip occurs through the orifice of the handle portion.

* * * * *